United States Patent [19]

Murata et al.

[11] 4,029,608

[45] June 14, 1977

[54] GRANULAR OR POWDERY DETERGENT COMPOSITION

[75] Inventors: Moriyasu Murata, Chiba; Fumio Sai, Funabashi; Takashi Fujino, Yokohama, all of Japan

[73] Assignee: Kao Soap Co., Ltd., Tokyo, Japan

[22] Filed: Sept. 21, 1976

[21] Appl. No.: 725,171

[30] Foreign Application Priority Data

Sept. 30, 1975 Japan ..... 50-117815

[52] U.S. Cl. ..... 252/551; 252/89 R; 252/135; 252/531; 252/534; 252/535; 252/536; 252/537; 252/539; 252/540; 252/550; 252/553; 252/554; 252/555; 252/556; 252/558; 252/559

[51] Int. Cl.[2] ..... C11D 1/72; C11D 1/83; C11D 3/20

[58] Field of Search ..... 252/89, 135, 531–540, 252/550–559, DIG. 1

[56] References Cited

UNITED STATES PATENTS

| | | | |
|---|---|---|---|
| 2,743,208 | 4/1956 | Marcuse | 252/384 X |
| 2,863,907 | 12/1958 | Schmerling | 260/473 |
| 3,009,882 | 11/1961 | Clarke et al. | 252/116 |
| 3,082,154 | 3/1963 | Allan | 252/384 |
| 3,154,497 | 10/1964 | Mankowich | 252/135 |
| 3,457,304 | 7/1969 | Amstutz | 260/539 |
| 3,950,275 | 4/1976 | Toyoda et al. | 252/527 |

FOREIGN PATENTS OR APPLICATIONS

| | | |
|---|---|---|
| 586,740 | 11/1959 | Canada |

*Primary Examiner*—P.E. Willis, Jr.
*Attorney, Agent, or Firm*—Woodhams, Blanchard and Flynn

[57] ABSTRACT

A granular or powdery detergent composition comprising a surface active agent having a tendency to cake, and containing as an anti-caking agent from 0.2 to 20 % by weight of a polyoxyethylene alkyl or alkenyl ether which is solid at room temperature and has the formula:

$$RO(CH_2CH_2O)_nH$$

wherein R is alkyl or alkenyl having 12 to 18 carbon atoms, and *n* is a number from 100 to 300.

4 Claims, No Drawings

GRANULAR OR POWDERY DETERGENT COMPOSITION

BACKGROUND OF THE INVENTION

1. Field of the Invention

The present invention relates to an improved granular or powdery detergent composition comprising an alkyl ether sulfate, branched alkyl sulfate, alkane sulfonate, vinylidene olefin sulfonate, internal olefin sulfonate, or nonionic surfactant, as a main component, and containing a polyoxyethylene alkyl or alkenyl ether as an anti-caking agent, whereby to reduce the tendency for said composition to cake or agglomerate.

2. Description of the Prior Art

Recently, the eutrophication problem caused by the use of sodium tripolyphosphate as a builder in powdery detergents has become important. It is now desired to reduce the content of sodium tripolyphosphate in detergents. In order to solve this problem, utilization of a surface active agent having a detergency that is not degraded by water hardness has recently been proposed and alkylethoxy sulfate salts and nonionic surfactants have attracted attention in the art. However, powdery detergents containing these surface active agents tend to cake and, therefore, they cannot easily be put into practical use.

The present invention relates to an improvement in granular or powder detergent compositions comprising at least one member selected from hard water-resistant surface active agents such as alkylethoxy sulfate slats, alkylphenylethoxy sulfate salts and ethylene oxide-type nonionic surface active agents and other surface active agents having a tendency to cake, such as branched alkyl sulfate salts, alkane-sulfonate salts, vinylidene-type olefin-sulfonate salts and internal olefin-type sulfonate salts, in which the caking tendency is remarkably reduced.

The caking property of a granular or powdery detergent has bad influences not only on the manufacturing steps but also on the handling of the detergent in households. The commercial value of a detergent having a tendency to cake is very low. Accordingly, it is very important to prevent caking of granular or powdery detergents.

It is known from experience that the caking property of a granular or powdery detergent is greatly influenced by the kin of the surface active agent contained therein. For example, sodium benzene-sulfonate and sodium toluene-sulfonate are effective for preventing caking of branched alkylbenzenesulfonate salts and sodium sulfosuccinate is effective for preventing caking of linear alkylbenzene-sulfonate salts. But is is said that the anti-caking effect of sodium sulfosuccinate is not high for the former surface active agents and the anti-caking effect of sodium benzene-sulfonate or sodium toluene-sulfonate is not high for the latter surface active agents.

Although the above-mentioned surface active agents having a tendency to cake possess an excellent detergency, granular or powdery detergent compositions containing these surface active agents tend to cake and their commercial values are very low.

SUMMARY OF THE INVENTION

We have discovered that a polyoxyethylene alkyl or alkenyl ether which is solid at ambient temperature, i.e., solid at temperatures below about 35° C, having the formula given below, imparts a very high anti-caking effect in detergent compositions containing a surface active agent having a tendency to cake. We have completed the present invention based on this finding. More specifically, in accordance with the present invention, there is provided a granular or powdery detergent composition comprising 0.2 to 20% by weight, preferably 1 to 10%, more preferably 2 to 6%, of a polyoxyethylene alkyl or alkenyl ether or a mixture of said ethers, having the formula: ps $$RO(CH_2CH_2O)_nH \qquad (I)$$

wherein R is alkyl or alkenyl having 12 to 18 carbon atoms, and $n$ is a number of from 100 to 300, preferably from 200 to 300.

As pointed out hereinbefore, a nonionic surface active agent of the polyoxyethylene alkyl or alkenyl ether type has been considered to cause caking in powdery compositions, and it has not been considered that this nonionic surface active agent would exhibit an anti-caking effect. Even when the average carbon atom number of the alkyl or alkenyl group in the above formula (I) is less than 12, the anti-caking effect is appreciable, but a sufficient effect cannot be obtained. The intended object of the present invention can be attained only when the average carbon atom number of the alkyl or alkenyl group is 12 or more. It is practically impossible to obtain an alcohol having an average carbon number larger than 18, and hence, such alcohol is excluded from the scope of the present invention. The alkyl or alkenyl group can be linear or branched.

A sufficient anti-caking effect cannot be obtained when $n$ (the mole number of added ethylene oxide units) is less than 100. When $n$ is 100 or larger, a practical anti-caking effect can be obtained and the effect is gradually improved as $n$ increases up to a maximum level obtained when $n$ is from about 200 to about 300. When $n$ exceeds 300, no substantial further increase of the intended anti-caking effect of the present invention is attained but ethylene oxide is wastefully used. Accordingly, it is preferred that $n$ is in the range of from 100 to 300, preferably 200 to 300.

The amount of the polyoxyethylene alkyl or alkenyl ether of formula (I) incorporated in the detergent composition is determined depending on the content of the surface active agent having a tendency to cake in the detergent compositions. The weight ratio of the formula (I) ether to the surface active agent having a tendency to cake, should be at least 10/100. In order for the surface active agent having a tendency to cake to exert its inherent high hard water-resistant washing activity or an ordinary washing activity, the surface active agent having a tendency to cake should be incorporated in an amount of at least 2 wt.% based on the total weight of the detergent composition. The ratio of the formula (I) ether to the surface active agent having a tendency to cake, must be at least 10/100 to obtain a sufficient anti-caking effect. If the surface active agent having a tendency to cake is incorporated in an amount larger than 40 wt.%, based on the total weight of the detergent composition, it is practically impossible to prevent caking. Accordingly, it is critical that the polyoxyethylene alkyl or alkenyl ether of formula (I) must be incorporated in an amount of at least 0.2 wt.%. Too large an amount is wasteful. Accordingly, the ether of formula (I) is incorporated in an amount of 0.2 to 20%, preferably 1 to 10%, more preferably 2 to 6%, by weight, based on the total weight of the detergent composition.

In practicing the present invention, it is preferred that the polyoxyethylene alkyl or alkenyl ether of formula (I) is incorporated in an amount of from 1/10 to 2 times the amount of the surface active agent having a tendency to cake, on a weight basis.

The polyoxyethylene alkyl or alkenyl ether of formula (I) can be obtained by adding ethylene oxide to a corresponding alcohol by a known method. Any natural and synthetic alcohols can be used provided that the average carbon atom number thereof is from 12 to 18. These alcohols may contain an ethylenic double bond.

Surface active agents having a tendency to cake, to which the anti-caking agent of the present invention is effectively applied, are as follows:

a. alkylethoxy sulfate salts and (b) alkylphenylethoxy sulfate salts respectively having the formulae:

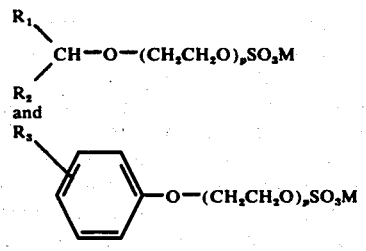

wherein $R_1$ and $R_2$ are hydrogen or alkyl or alkenyl having 1 to 17 carbon atoms, $R_3$ is alkyl or alkenyl having 4 to 16 carbon atoms, the average carbon atom number of the alcohol or alkyl phenol prior to addition of ethylene oxide being 10 to 18, $p$ is a number from 0.5 to 5, and M is an alkali metal or alkaline earth metal.

c. branched alkyl sulfate salts having the formula:

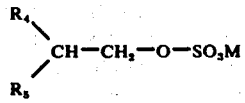

wherein $R_4$ and $R_5$ are alkyl or alkenyl having 1 to 15 carbon atoms, and the total number of carbon atoms of

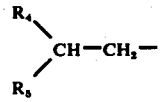

being in the range of from 10 to 18, and M is alkali metal or alkaline earth metal.

d. alkane-sulfonate salts having the formula:

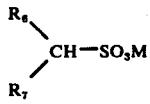

wherein $R_6$ and $R_7$ are hydrogen or alkyl having 1 to 17 carbon atoms, with the proviso that the total number of carbon atoms in

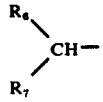

is in the range of from 10 to 18, and M stands for an alkali metal or alkaline earth metal.

e. vinylidene type olefin-sulfonate salts, for example, sulfonate salts of olefins having the formula:

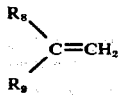

wherein $R_8$ and $R_9$ are alkyl having 1 to 15 carbon atoms, with the proviso that the total number of carbon atoms in one molecule is in the range of from 10 to 18, and the salt is an alkali metal or alkaline earth metal salt.

f. internal olefin-sulfonate salts, for example, sulfonate salts of olefins having the formula;

$R_{10}HC = CHR_{11}$ wherein $R_{10}$ and $R_{11}$ are hydrogen or alkyls having 1 to 17 carbon atoms, with the proviso that the total number of carbon atoms of one molecule is in the range of from 10 to 20, when one of $R_{10}$ and $R_{11}$ is hydrogen atom, the olefin is an $\alpha$-olefin may be incorporated in an amount not exceeding 80 wt.%, and the salt is an alkali metal or alkaline earth metal salt.

g. ethylene oxide-type nonionic surface active agents, such as polyoxyethylene alkyl or alkenyl ethers that are obtained by adding 6 to 12 mols of ethylene oxide to a $C_{12}$ to $C_{18}$ alcohol, polyoxyethylene alkylaryl ethers that are obtained by adding 6 to 12 mols of ethylene oxide to alkylphenols having a $C_6$ to $C_{10}$ alkyl group, polyoxethylene saturated or unsaturated fatty acid esters that are obtained by adding 8 to 20 moles of ethylene oxide to $C_{12}$ to $C_{18}$ fatty acid and polyoxyethylene (4 to 20 mol) sorbitan saturated or unsaturated fatty acid ($C_{12}$ to $C_{18}$) esters, each having an HLB value of from 8 to 18.

The detergent composition of the present invention contains from 2 to 40% of at least one of said detergents having a tendency to cake, as a critical component. In addition, the detergent composition of the present invention can contain 0 to 20% by weight of other surface active agents (different from surface active agents (a) to (g)), for example, sodium and potassium salts of alkylbenzene-sulfonic alkyl sulfuric acid esters having an average carbon number of 11 to 18 and $\alpha$-olefin-sulfonic acids having an average carbon number of 10 to 20; 10 to 40% by weight of inorganic or organic detergent builders, such as condensed phosphoric acid salts, e.g., sodium tripolyphosphate and sodium pyrophosphate, silicates, carbonates, Glauber salt and borates; organic builders such as nitrilotriacetic acid salts and citric acid salts; anti-redeposition agents such as carboxymethylcellulose, polyvinyl alcohol and polyvinyl pyrrolidone; enzymes; bleaching agents; fluoroscent dyes; bluing agents; perfumes; and other additives customarily used in conventional clothes-washing detergent compositions.

This invention will now be further described by reference to the following illustrative Examples.

Each of the samples used in these Examples was prepared and tested in the following manner:

A detergent slurry comprising 60% by weight of detergent components and 40% by weight of water was charged into a mixing tank of 10 cm in diameter and 12 cm in depth, provided with a heating jacket. The slurry was mixed and agitated uniformly at 60° C and then was allowed to stand still for 15 minutes. The slurry was then dried at 60° to 80° C under reduced pressure in a vacuum drum drier until the water content was reduced to substantially zero. The resulting powdery detergent was sieved and particles of a size of 420 to 710$\mu$ were recovered and allowed to stand still in a tank maintained at a temperature of 30° C and a relative humidity of 80% to adjust the water content to 9 ± 1% by weight, following which the detergent was tested.

The caking property was determined in the following manner:

12.5 g of the samples was placed in a container formed on filter paper (7.4 cm × 4.4 cm × 2.8 cm (height)), and the sample was levelled. An iron plate having a size of 7.2 cm × 4.2 cm was placed on the sample, and in this state the sample was allowed to stand still in a thermostat tank maintained at a temperature of 30° C and a relative humidity of 80% for 7 days. Then, the powdery detergent was placed on a sieve of 4 mm × 4 mm mesh so as to be permitted to pass therethrough by gravity. The weight A (g) of the powder that remained on the sieve and the weight B (g) of the powder that passed through the sieve were measured. The passage ratio was calculated according to the following equation:

$$\text{Passage ratio (\%)} = \frac{B}{A+B} \times 100$$

A larger value of the passage ratio indicates a lower degree of caking.

EXAMPLE 1

According to the prescribed methods set forth above, powdery detergents having the following compositions were prepared and their passage ratios were determined.

| | |
|---|---|
| Sodium linear dodecylbenzenesulfonate | 10 parts |
| Sodium alkyl ethoxysulfate* | 10 parts |
| Sodium tripolyphosphate | 20 parts |
| Sodium silicate (JIS No. 2) | 10 parts |
| Sodium carbonate | 5 parts |
| Carboxymethylcellulose | 1 part |
| Water | 8 parts |
| Caking-preventing agent (indicated in Table 1) | 5 parts |
| Glauber salt | balance |
| Total | 100 parts |

*Sodium salt obtained by adding 2.8 moles of ethylene oxide to a mixture of a branched higher alcohol and a linear higher alcohol (Oxocol 1415 manufactured by Nissan Kagaku and having an average carbon atom number of 14.5 and containing 40% of a branched alcohol in the mixture), and sulfating and neutralizing the adduct.

Table 1

| Sample No. | Caking-Preventing Agent | Remarks | Passage Ratio (%) |
|---|---|---|---|
| 1 | not added | comparison | 20 |
| 2 | sodium benzene-sulfonate | " | 25 |
| 3 | sodium toluene-sulfonate | " | 28 |
| 4 | sodium sulfosuccinate | " | 30 |
| 5 | polyoxyethylene($\bar{P}$ = 10)stearyl ether*1 | " | 19 |
| 6 | polyoxyethylene($\bar{P}$ = 50)stearyl ether | " | 32 |
| 7 | polyoxyethylene($\bar{P}$ = 100)stearyl ether | present invention | 85 |
| 8 | polyoxyethylene($\bar{P}$ = 200)stearyl ether | " | 91 |
| 9 | polyoxyethylene($\bar{P}$ = 300)stearyl ether | " | 94 |
| 10 | polyoxyethylene($\bar{P}$ = 400)stearyl ether | comparison | 94 |
| 11 | polyoxyethylene($\bar{P}$ = 200)octyl ether | " | 49 |
| 12 | polyoxyethylene($\bar{P}$ = 200)dodecyl ether | present invention | 58 |
| 13 | oxoalcohol-ethylene oxide adduct ($\bar{P}$ = 180)*2 | " | 84 |
| 14 | oxoalcohol ethylene oxide adduct ($\bar{P}$ = 250)*3 | " | 54 |
| 15 | higher alcohol ethylene oxide adduct ($\bar{P}$ = 280)*4 | " | 92 |
| 16 | polyoxyethylene($\bar{P}$ = 250)oleyl ether | " | 90 |

As will readily be understood from the results shown in Table 1, Sample Nos. 2 and 4 show that known branched or linear alkylbenzene-sulfonate anti-caking agents have no caking-preventing effect to a detergent composition comprising alkyl ethoxy sulfates which have a tendency to cake, but a polyoxyethylene alkyl or alkenyl ether produced by adding at least 100 moles of ethylene oxide to an alcohol having an average carbon number of at least 12 imparts a high caking-preventing effect to such a detergent composition. A polyoxyethylene ether having an alkyl or alkenyl group of more than 18 carbon atoms is not specifically disclosed, because it is practically impossible to obtain such an ether and it is not included in the scope of the present invention. When a polyoxyethylene ether having more than 300 moles of ethylene oxide added is used, no additional improved effect is obtained and excessive ethylene oxide is wastefully consumed.

EXAMPLE 2

The relation between the amount incorporated of the anti-caking agent and the anti-caking effect was examined. The results are shown in Table 2.

Table 2

| Composition (parts) | Sample No. 17 | 18 | 19 | 20 | 21 | 22 | 23 | 24 | 25 | 26 |
|---|---|---|---|---|---|---|---|---|---|---|
| Sodium linear dodecylbanzene-sulfonate | 10 | 10 | 10 | 18 | 18 | 18 | 0 | 0 | 0 | 0 |
| Sodium alkylethoxy-sulfate used in Example 1 | 2 | 2 | 2 | 7 | 7 | 7 | 30 | 30 | 30 | 45 |
| Sodium silicate | 10 | 10 | 10 | 10 | 10 | 10 | 5 | 5 | 5 | 0 |
| Sodium carbonate | 5 | 5 | 5 | 5 | 5 | 5 | 5 | 5 | 5 | 0 |
| Carboxymethylcellulose | 1 | 1 | 1 | 1 | 1 | 1 | 1 | 1 | 1 | 0 |
| Water | 10 | 10 | 10 | 8 | 8 | 8 | 5 | 5 | 5 | 2 |
| Polyoxyethylene($\bar{P}$ + 200)stearyl ether | 0 | 0.1 | 0.2 | 0 | 0.4 | 1 | 0 | 20 | 50 | 53 |
| Sodium tripolyphosphate | 15 | 15 | 15 | 10 | 10 | 10 | 0 | 0 | 0 | 0 |
| Glauber salt | | ← | | | balance | | | | → | |
| Total | 100 | 100 | 100 | 100 | 100 | 100 | 100 | 100 | 100 | 100 |
| Remarks* | B | B | A | B | B | A | B | A | B | B |
| Passage Ratio | 40 | 42 | 55 | 0 | 35 | 59 | 0 | 54 | 56 | 32 |

*A present invention
B comparison

As shown in Table 2, a sufficient anti-caking effect can be obtained when the polyoxyethylene alkyl ether is incorporated in an amount of at least 10 parts, per 100 parts of the surface active agent having a tendency to cake (see Sample Nos. 19 and 22). In other words, because in order to obtain a significant detergent power, the surface active agent having a tendency to cake must be incorporated in an amount of at least 2%, based on the total composition, the caking-preventing agent must be incorporated in an amount of at least 0.2%. Incorporation of more than 20% of the caking-preventing agent is unnecessary because it is wastefully consumed (see Sample Nos. 24 and 25). If the amount of the caking surface active agent exceeds 40%, it is practically impossible to prevent caking (see Sample No. 26).

EXAMPLE 3

A powdery detergent having the following composition was prepared, and the passage ratio was evaluated to determine the caking tendency.

| | |
|---|---|
| Surface active agent (shown in Table 3) | a parts |
| Sodium tripolyphosphate | 20 parts |
| Sodium silicate (JIS No. 2) | 10 parts |
| Sodium carbonate | 5 parts |
| Carboxymethylcellulose | 0.8 parts |
| Polyethylene glycol (average molecular weight = 6000) | 0.2 parts |
| Water | 8 parts |
| Polyoxyethylene ($\bar{P}$ = 200) stearyl ether | b parts |
| Glauber salt | balance |
| Total | 100 parts |

Table 3

| Sample No. | Surface Active Agent | a (parts) | b (parts) | * Remarks | Passage Ratio (%) |
|---|---|---|---|---|---|
| 27 | Sodium alkylethoxy-sulfate*1 | 15 | 0 | B | 0 |
| 28 | " | 15 | 3 | A | 70 |
| 29 | Sodium alkylethoxy-sulfate*2 | 20 | 0 | B | 0 |
| 30 | "ditto | 20 | 5 | A | 71 |
| 31 | Sodium branched alkyl*3 sulfate | 30 | 0 | B | 42 |
| 32 | " | 30 | 5 | A | 82 |
| 33 | Sodium alkane-sulfonate*4 | 35 | 0 | B | 8 |
| 34 | " | 35 | 10 | A | 88 |
| 35 | Sodium vinylidene type*5 olefin-sulfonate | 18 | 0 | B | 43 |
| 36 | " | 18 | 10 | A | 95 |
| 37 | Sodium internal olefin-*6 sulfonate | 17 | 0 | B | 28 |
| 38 | " | 17 | 4 | A | 80 |
| 39 | Polyoxyethylene dodecyl*7 ether | 10 | 0 | B | 12 |
| 40 | " | 10 | 10 | A | 65 |
| 41 | Sodium linear dodecyl benzene-sulfonate | 20 | 0 | B | 96 |
| 42 | " | 20 | 5 | B | 98 |
| 43 | Sodium linear alkyl sulfate*8 | 20 | 0 | B | 98 |
| 44 | " | 20 | 3 | B | 100 |
| 45 | Sodium α-olefin-sulfonate*9 | 20 | 0 | B | 99 |
| 46 | " | 20 | 3 | B | 100 |

*A present invention
B comparison
Notes
Surface active agents indicated in Table 3 are as follows:
*1 Sodium salt prepared by adding 3.4 moles of ethylene oxide to a linear higher alcohol (having an average carbon atom number of 14) and sulfating and neutralizing the adduct.
*2 Unitol C-2 [manufactured by Nippon Unitol; sodium salt of secondary higher alcohol (carbon atom number of 14 to 15) ethoxysulfate].
*3 Sodium salt of a sulfated product of oxoalcohol having an average molecular weight of 205.
*4 Hostapur 60 (manufactured by Hoechst; average molecular weight = 319).
*5 The average carbon number is 16.
*6 Sodium salt of olefin-sulfonate (the olefin is composed mainly of internal olefin; α-olefin/internal olefin = 20/80; average carbon number = 16.2).
*7 The mole number of added ethylene oxide is 8.4.
*8 Sodium salt of a sulfuric acid ester of a linear higher alcohol (having an average carbon number of 14).
*9 Dialene 168 (manufactured by Mitsubishi Kasei; sodium α-olefin-sulfonate derived from lenear α-olefin in which the $C_{16}$ content is 57.3% and the $C_{18}$ content is 42.7%).

From the results shown in Table 3, it will readily be understood that although powdery detergents containing a surface active agent have a high tendency to cake, caking of detergents (A) of the present invention including a polyoxyethylene ($\bar{p}$=200) stearyl ether is reduced greatly.

The embodiments of the invention in which an exclusive property or privilege is claimed ae defined as follows:

1. A granular or powdery detergent composition consisting essentially of

I. from 2 to 40 percent by weight of a first surfactant having a tendency to cake selected from the group consisting of a. alkylethoxy sulfates having the formula

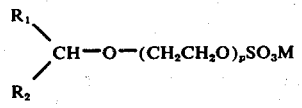

wherein $R_1$ and $R_2$, which can be the same or different, are hydrogens, alkyls having one to 17 carbon atoms, or alkenyls having one to 17 carbon atoms, provided that the average carbon atom number of

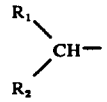

is from 10 to 18 carbon atoms, $p$ is a number of from 0.5 to 5, and M is an alkali metal or an alkaline earth metal, b. alkylphenylethoxy sulfates having the formula

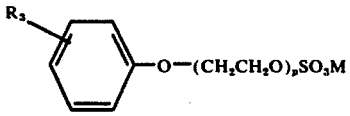

wherein $R_3$ is alkyl having 4 to 16 carbon atoms or alkenyl having 4 to 16 carbon atoms, provided that the average carbon atom number of

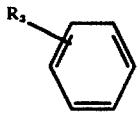

is from 10 to 18, and *p* and M are the same as defined above, c. branched alkyl sulfates having the formula

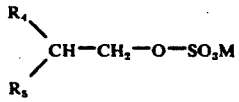

wherein $R_4$ and $R_5$, which can be the same or different, are alkyls having one to 15 carbon atoms or alkenyls having one to 15 carbon atoms, provided that

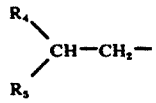

contains from 10 to 18 carbon atoms, and M is the same as defined above, d. alkane sulfonates having the formula

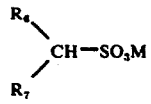

wherein $R_6$ and $R_7$, which can be the same or different, are hydrogens or alkyls having one to 17 carbon atoms, provided that

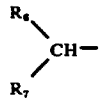

contains from 10 to 18 carbon atoms and M is the same as defined above, e. sulfonate salts of vinylidene olefins having the formula

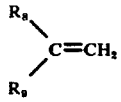

wherein $R_8$ and $R_9$, which can be the same or different, are alkyls having 1 to 15 carbon atoms, provided that the number of carbon atoms in the olefin molecule is from 10 to 18, and the salt-forming cation is an alkali metal or alkaline earth metal, f. sulfonate salts of internal olefins having the formula $$R_{10}HC{=}CHR_{11}$$

wherein $R_{10}$ and $R_{11}$, which can be the same or different, are hydrogens or alkyls having one to 17 carbon atoms, provided that the number of carbon atoms in the olefin molecule is from 10 to 20 and further provided that in up to 80 wt.% of the olefin molecules, one of $R_{10}$ and $R_{11}$ can be hydrogen, and in the balance of the olefin molecules, neither of $R_{10}$ and $R_{11}$ is hydrogen, and the salt-forming cation is an alkali metal or alkaline earth metal, g. ethylene oxide nonionic surface active agents having an HLB value of from 8 to 18 and selected from the group consisting of polyoxyethylene (6 to 12) alkyl ($C_{12}$ to $C_{18}$) or alkenyl ($C_{12}$ to $C_{18}$) ethers, polyoxyethylene (6 to 12) alkyl ($C_6$ to $C_{10}$) phenyl ethers, polyoxyethylene (8 to 20) saturated or unsaturated fatty acid ($C_{12}$ to $C_{18}$) esters and polyoxyethylene (4 to 20) sorbitan saturated or unsaturated fatty acid ($C_{12}$ to $C_{18}$) esters, and mixtures thereof, II. from 0.2 to 20 percent by weight of an anti-caking agent having the formula $$RO(CH_2CH_2O)_nH$$

wherein R is alkyl or alkenyl having 12 to 18 carbon atoms, and *n* is a number from 100 to 300, the weight ratio of II/I being at least 10/100 or higher, III. from zero to 20 percent by weight of second surfactant selected from the group consisting of alkylbenzene sulfonates in which the alkyl has 10 to 16 carbon atoms, linear alkyl sulfates having an average of 11 to 18 carbon atoms, α-olefin sulfonates having 10 to 20 carbon atoms and mixtures thereof; and IV. from 10 to 40 weight percent of water-soluble inorganic alkaline detergent builders, or water-soluble inorganic neutral detergent builders, or water-soluble organic detergent builders, or mixtures thereof.

2. A composition as claimed in claim 1 in which the amount of component II is from 1 to 10 weight percent, and *n* of component II is from 200 to 300.

3. A composition as claimed in claim 2 in which the amount of component II is from 2 to 6 weight percent.

4. A composition as claimed in claim 1 in which the weight ratio of II/I is from 1/10 to 2/1.

* * * * *